US005468051A

United States Patent [19]

Huang

[11] Patent Number: 5,468,051

[45] Date of Patent: Nov. 21, 1995

[54] ADJUSTABLE HIGHCHAIR

[75] Inventor: Y. H. Huang, Tainan City, Taiwan

[73] Assignee: Lu Kuang Incorporation, Tainan City, Taiwan

[21] Appl. No.: 294,577

[22] Filed: Aug. 23, 1994

[51] Int. Cl.[6] ..... A47C 1/06

[52] U.S. Cl. ..... 297/344.18; 297/344.12; 248/125.3

[58] Field of Search ..... 297/344.18, 344.12, 297/338; 292/37, 33, 140, 169.12; 248/125 X

[56] References Cited

U.S. PATENT DOCUMENTS 2,937,692 5/1960 McMichael ..... 297/344.18

5,348,374 9/1994 Kuo ..... 297/344.18

FOREIGN PATENT DOCUMENTS 1809240 11/1968 Germany .

*Primary Examiner*—Kenneth J. Dorner
*Assistant Examiner*—Anthony D. Barfield
*Attorney, Agent, or Firm*—Morton J. Rosenberg; David I. Klein

[57] ABSTRACT

An adjustable hichair includes a seat support having a pair of sleeves at rear respective sides adapted to be inserted into a pair of struts of a chair frame in a slidable manner so as to adjust the height of the seat to a most convenient position.

1 Claim, 4 Drawing Sheets

ADJUSTABLE HIGHCHAIR

FIELD OF THE INVENTION

This invention relates to a baby hichair, and more particular to a hichair having a seat adjustable to the most favorable position.

BACKGROUND OF THE INVENTION

It was always a problem for parents to feed their babies especially in restaurants because of their height and causing parents finding difficult to enjoy their meal. Sometimes babies like to move or run in a restaurant that will cause accident easily.

High chairs are therefore invented which has a tray detachably attached to the high chair so that babies can feed themself without disturbing their parents. However, the high chair of prior art has a fixed height of the tray which can not be adjusted and this height may not fit the height of all dinging tables. Therefore, parents will have to adjust them to feed babies when a dining table does not match the height of a high chair.

SUMMARY OF THE INVENTION

It is the primary object of the present invention to provide an adjustable hichair which seat's height is adjustable.

It is another object of the present invention to provide an adjustable hichair which is easy to operate.

It is further object of the present invention to provide an adustable hichair which is inexpensive to manufacture.

BRIEF DESCRIPTION OF THE DRAWINGS

FIG. 5 is a prior art.

DETAILED DESCRIPTION OF THE PREFERRED EMBODIMENT

Reference is now made to the drawings wherein the showings are for the purpose of illustrating a preferred embodiment only and not for the purpose of limiting an inventive concept.

Figure 1:
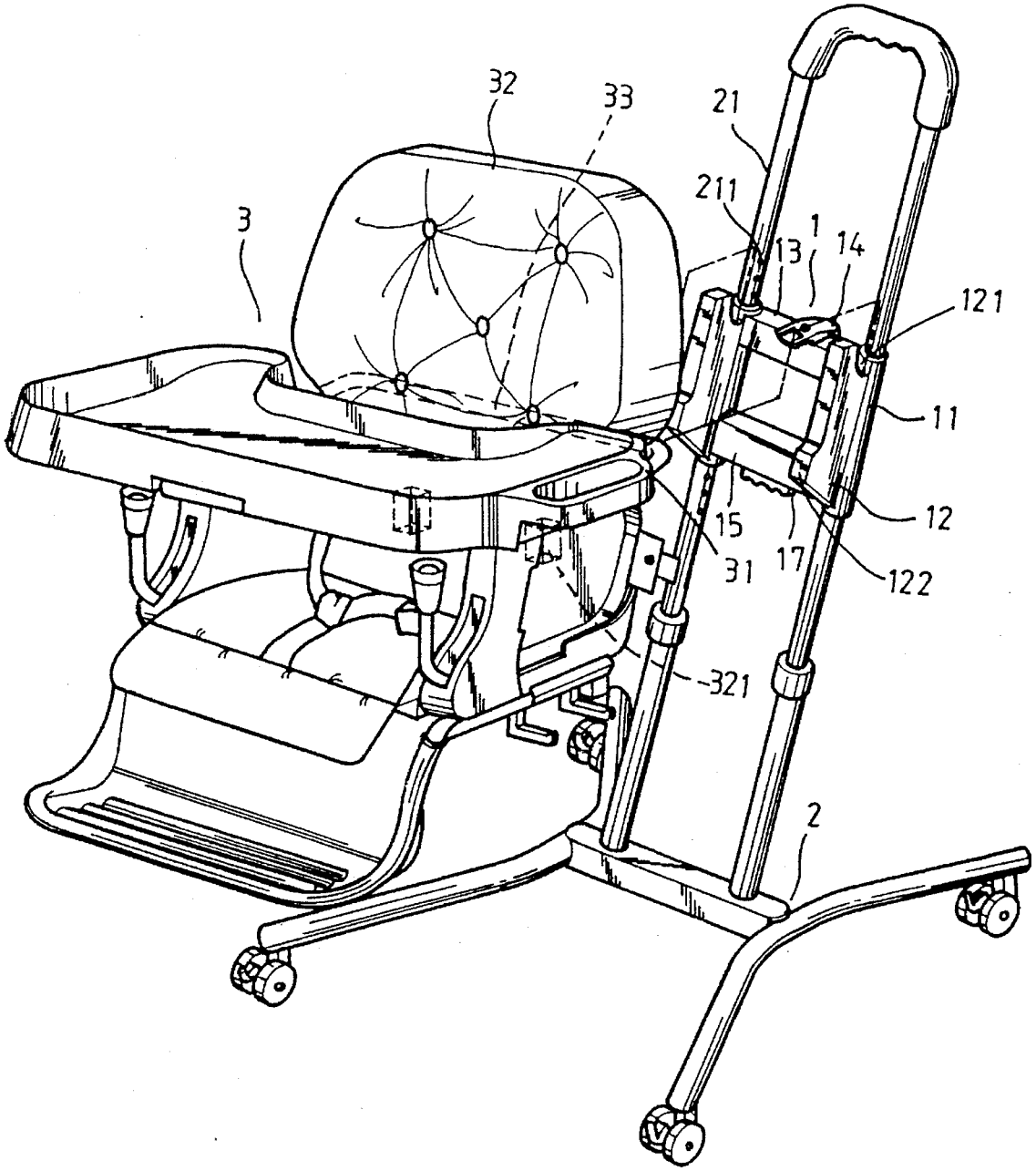
FIG. 1 is a fraqmentary view of a seat support and a seat of the present invention.

FIG. 1 shows the present invention has composed of a seat support 1 being slidably mounted to a pair of chair frame 2 which has a pair of struts 21 having a plurality of apertures along two inner sides, and a seat 3.

Figure 2:
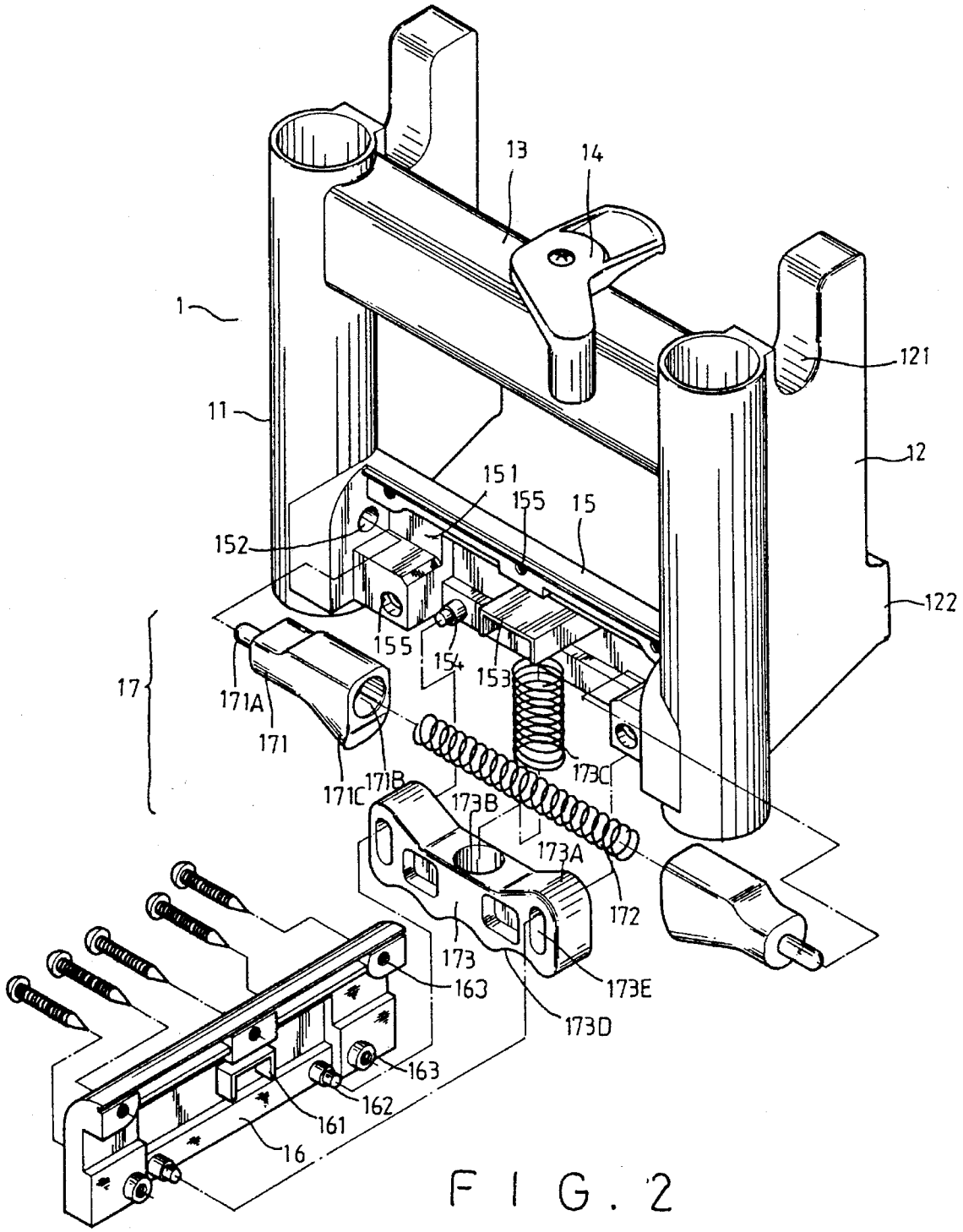
FIG. 2 exploded view of the seat support of FIG. 1.
Figure 3:
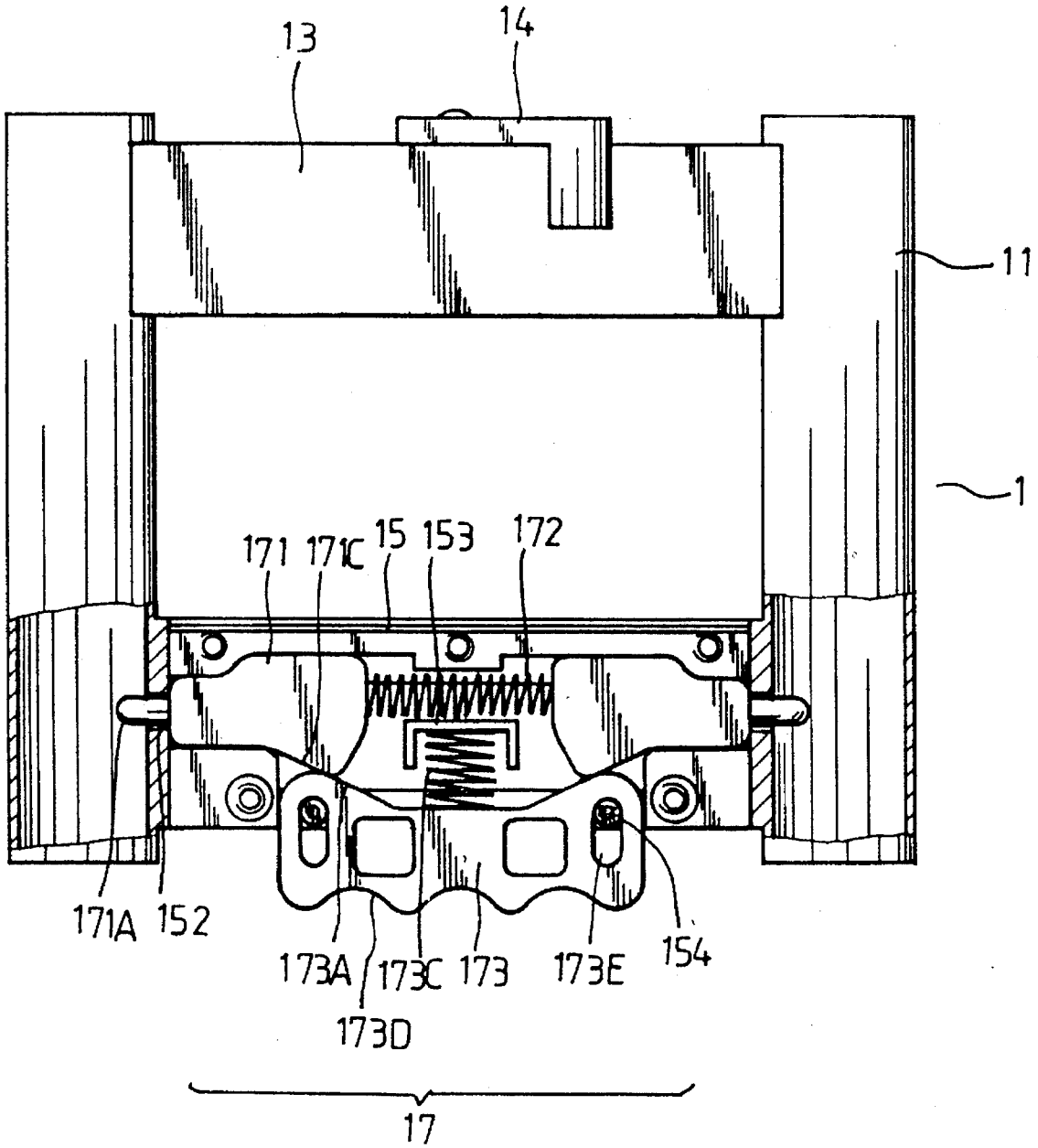
FIG. 3 is a front perspective view of the seat support of FIG. 1 having partially sectioned.

The seat support 1, according to FIG. 2, includes a pair of sleeves 11 at respective rear sides each having an inner diameter equal to the outer diameter of the chair frame 2 so as to sleeve on the struts 21 of the chair frame 2. A pair of seat holders; 12 extending from the sleeves 11 incldue a pair of qrooves 121 at top portions thereof, a pair of protruding blocks 122 at bottom portions thereof. A connecting rod 13 is inteqrally formed at top to connect the two sleeves 11 toqether, a medal lip 14 being swivably attached to the connecting bar 13. A container 15 at bottom of the seat support. 1 has a pair of grooves 151 at respective upper inner portions, a pair of bores 152 at respective sides, a block 153 extending from the inner wall of the container 15, a pair of pins 154 located at respective sides of the block 153. A plurality of apertures 155. A cover 16 adapted to cover the container 15 has a block 161, a pair of pins 162 and a plurality of apertures 163, all of the block 161, the pins 162 and apertures 163 are aligned with the block 153. The pins 154 and apertures 155. A sliding mechanism 17 seated in the container has a pair of identical enqaqing members 171 and a linking member 173. Each engaging member 171 has a pin 171A extending from one end and a bore 171B at the opposite end adapted to receive a spring 172 therein. The bottom portion of each engaging member 171 closed to the bore 171B has an arcuate surface 171C. The pins 171A are adapted to be inserted into the apertures 152 at respective inner wall that will limit the movement of the sliding mechanism 17. The linking member 173 includes a pair of arcuate surfaces 173A which corredspond to the shape of the arcuate surfaces 171C adapted to support the engaging members 171 thereon, an aperture 173B at center adapted to receive a spring 173C therein, whereas the other end of the spring 173C engages with the block 153. That urges the sliding mechanism 171 downward in a constant manner. A gripping area 173D is formed at bottom portion in a wave form for fingers to qrip thereat. A pair of trough 173E are formed at respective sides of the linking member 173 adapted for the pins 154 and 162 to extend therin, as shown in FIG. 3.

The seat 3 includes an armrest 31 having extending therefrom to form a crossbar 33 at the rear end of the backrest 32, and a pair of notches 321 at rear lower end.

To assemble, place the seat 3 on the seat support 2 with the crossbar 33 rest in the grooves and the protruding blocks 122 into the notches 321, then turn the medal 14 to block the crossbar 33 form moving. Place the engaging members 171 in the grooves 151 and insert the pins 171A into the apertures 152. Place the spring 173C into the bore 173B and the linking member 173 into the container 15 with the two pins 154 insert into the aperture 173E. The arcuate surfaces 171C of the engaging members 171 are seating on the arcuate surfaces 173A. Close the container 15 with cover 16 and fastened with fasteners and the assemblying procedure is completed.

Figure 4:
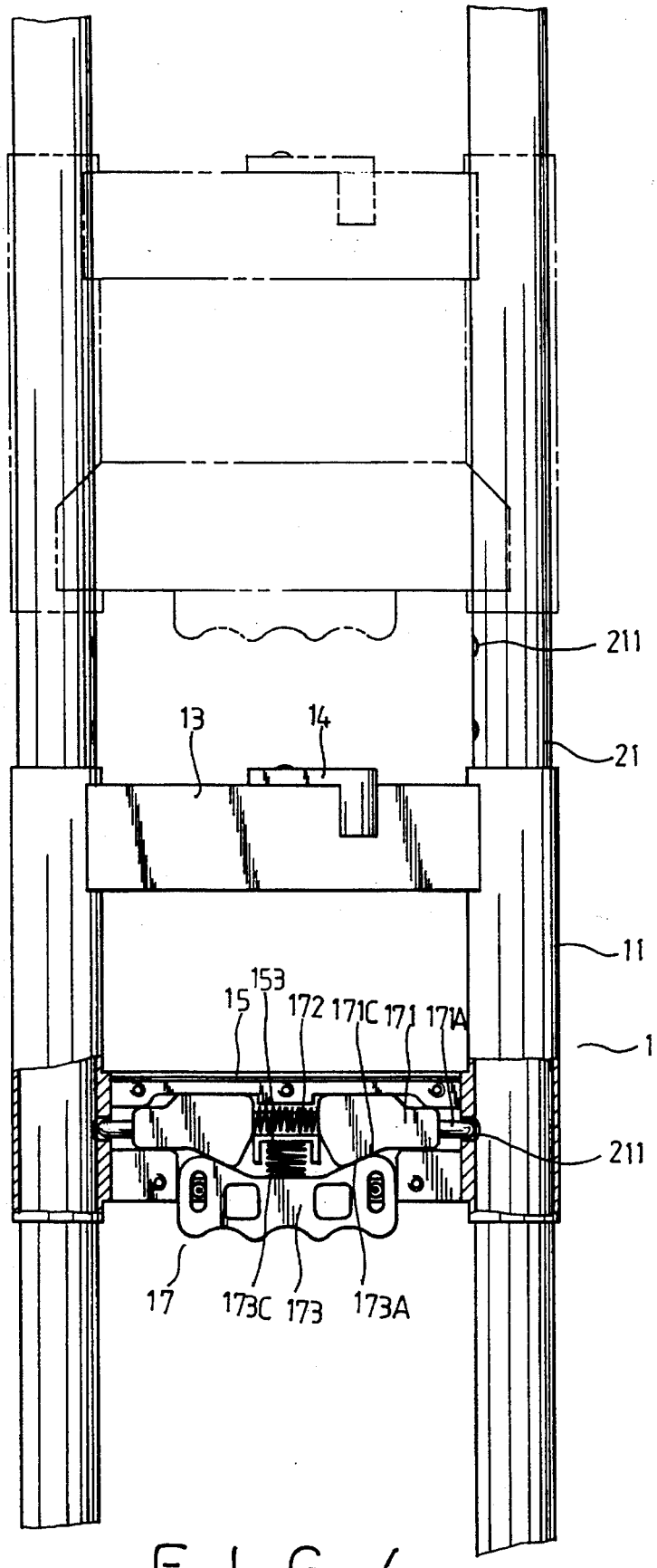
FIG. 4 is an enlarged view of FIG. 3 sliding on a pair of chair struts showing in phantom line.

To adjust the height of the seat 3, grip the gripping area 173D and pull upward this will slide the engaging members 171 inwardly, as shown in FIG. 4, and bringing the pins 171A to depart from the apertures 152, thus the seat support 1 and the seat 3 itself are slidable to whatever the position is desired. Upon the seat 3 has reached to a desired and the gripping area 173D is released, the pins 171A will insert into the apertures 211 which hold the seat support 1 and the seat 3 firmly.

I claim:

1. An adjustable highchair, comprising:

a seat support having a pair of sleeves slidingly disposed on a pair of struts having a connecting bar and a container;

a seat having a pair of armrests and a crossbar extending from said armrests, said seat being detachably coupled to said seat support;

said container having a pair of grooves formed at respective opposing upper inner portions thereof, a pair of through bores formed in respective opposing sides of said container in open communication with a respective interior portion of said sleeves, and a first block extending from an inner wall of said container, said container further having a pair of first pins located on opposing sides of said first block, a plurality of first apertures formed in an upper edge of said container and a plurality of second apertures formed in a lower edge of said container;

a cover for forming a closure for said container having a second block extending from inner wall thereof and disposed in aligned relation with said first block of said container, said cover further having a pair of second pins disposed on opposing sides of said second block and in aligned relation with said pair of first pins, a plurality of third apertures formed through an upper edge of said cover and disposed in aligned relation with said plurality of first apertures and a plurality of fourth apertures formed through a lower edge of said cover and disposed in aligned relation with said plurality of second apertures; and, a sliding mechanism disposed within said container and enclosed by said cover, said sliding mechanism including a pair of engaging members slidingly disposed within said grooves of said container, a first spring disposed between said pair of engaging members, a linking member centrally disposed below said pair of engaging members and a second spring for biasing said linking member, each of said engaging members having (1) a third pin formed on a distal end thereof for insertion into a respect through bore of said container, (2) an opening formed in a proximal end thereof to receive said first spring therein for urging said engaging members outwardly, and (3) an arcuate camming surface formed on a bottom portion thereof, said linking member having a pair of arcuate camming surfaces disposed at respective opposing ends of a top portion thereof for matingly engaging said arcuate camming surfaces of said pair of engaging members, and a bore formed centrally in said top portion for receipt of one end of said second spring, an opposing end of said second spring being engaged with said first block of said container for urging said linking member downwardly, said linking member having a gripping area formed in a bottom portion thereof, and a pair of spaced slotted openings formed therethrough adapted to respectively receive therein said pair of first pins form one side and said pair of second pins from an opposing side thereof, whereby said third pins of said engaging members will be displaced from said container through bores responsive to said gripping area being pushed upwardly to thereby free said seat support to slide along said struts of said seat frame until said gripping area is released and said third pins of said engaging members are reinserted into said through bores of said container.

* * * * *